US011753934B2

(12) United States Patent
Hunnur et al.

(10) Patent No.: US 11,753,934 B2
(45) Date of Patent: Sep. 12, 2023

(54) AUTOMATED CONTAMINATION PREDICTION BASED ON DOWNHOLE FLUID SAMPLING

(71) Applicants: Anup Hunnur, Tomball, TX (US); Sefer Coskun, The Woodlands, TX (US)

(72) Inventors: Anup Hunnur, Tomball, TX (US); Sefer Coskun, The Woodlands, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/387,042

(22) Filed: Jul. 28, 2021

(65) Prior Publication Data

US 2022/0034224 A1 Feb. 3, 2022

Related U.S. Application Data

(60) Provisional application No. 63/058,082, filed on Jul. 29, 2020.

(51) Int. Cl.
*E21B 49/08* (2006.01)

(52) U.S. Cl.
CPC ..... *E21B 49/081* (2013.01)

(58) Field of Classification Search
CPC ... E21B 49/081; E21B 49/08; G01N 33/2823; G01N 1/14; G06F 17/17; G06Q 50/02
See application file for complete search history.

(56) References Cited

U.S. PATENT DOCUMENTS

| | | | | |
|---|---|---|---|---|
| 7,445,934 | B2 | 11/2008 | DiFoggio et al. | |
| 2003/0065476 | A1* | 4/2003 | Schmidt | G06F 17/17 702/179 |
| 2006/0241866 | A1 | 10/2006 | DiFoggio | |
| 2007/0238180 | A1* | 10/2007 | DiFoggio | G01N 33/2823 436/28 |
| 2013/0046483 | A1 | 2/2013 | Mansouri et al. | |

(Continued)

FOREIGN PATENT DOCUMENTS

| | | | |
|---|---|---|---|
| JP | 2004132706 | A | 4/2004 |
| WO | 2015113019 | A1 | 7/2015 |

OTHER PUBLICATIONS

International Search Report Issued in International Application No. PCT/US2021/043277 dated Nov. 8, 2021; 6 Pages.

(Continued)

*Primary Examiner* — Michael J Dalbo
*Assistant Examiner* — Kaleria Knox
(74) *Attorney, Agent, or Firm* — CANTOR COLBURN LLP

(57) ABSTRACT

Examples described herein provide a downhole sampling method that includes receiving fluid data from a fluid downhole in a wellbore operation. The method further includes defining a subset of the fluid data and a remaining subset of the fluid data. The method further includes iteratively generating, by a processing device, a plurality of curves fit to the subset of the fluid data. The method further includes performing, by the processing device, a validation on the plurality of curves as applied to the remaining subset of the fluid data to determine one or more best fit curves from the plurality of curves.

20 Claims, 7 Drawing Sheets

(56) References Cited

U.S. PATENT DOCUMENTS

| | | | | |
|---|---|---|---|---|
| 2016/0186562 | A1* | 6/2016 | Lee | G06Q 50/02 702/6 |
| 2017/0152743 | A1* | 6/2017 | Gisolf | G01N 1/14 |
| 2017/0328202 | A1* | 11/2017 | Hsu | E21B 49/10 |
| 2018/0320516 | A1* | 11/2018 | Price | E21B 49/08 |
| 2019/0301936 | A1 | 10/2019 | DiFoggio et al. | |

OTHER PUBLICATIONS

Written Opinion Issued in International Application No. PCT/US2021/043277 dated Nov. 8, 2021; 6 Pages.

* cited by examiner

AUTOMATED CONTAMINATION PREDICTION BASED ON DOWNHOLE FLUID SAMPLING

CROSS-REFERENCE TO RELATED APPLICATIONS

This application is the Non-Provisional application, which claims priority to U.S. Provisional Patent Application Ser. No. 63/058,082 filed Jul. 29, 2020, the disclosure of which is incorporated herein by reference in its entirety.

BACKGROUND

Embodiments described herein relate generally to downhole exploration and production efforts in the resource recovery industry and more particularly to techniques for automated contamination prediction based on downhole fluid sampling.

Downhole exploration and production efforts involve the deployment of a variety of sensors and tools. The sensors provide information about the downhole environment, for example, by collecting data about temperature, density, saturation, and resistivity, among many other parameters. This information can be used to control aspects of drilling and tools or systems located in the bottom hole assembly, along the drillstring, or on the surface.

SUMMARY

Embodiments of the present invention are directed to automated contamination prediction based on downhole fluid sampling.

A non-limiting example downhole sampling method includes receiving fluid data from a fluid downhole in a wellbore operation. The method further includes defining a subset of the fluid data and a remaining subset of the fluid data. The method further includes iteratively generating, by a processing device, a plurality of curves fit to the subset of the fluid data. The method further includes performing, by the processing device, a validation on the plurality of curves as applied to the remaining subset of the fluid data to determine one or more best fit curves from the plurality of curves.

A non-limiting example system includes a drilling rig including a bottom hole assembly disposed in a wellbore and configured to acquire fluid data. The system further includes a processing system including a memory and a processor, the processing system being disposed at a surface of the wellbore, the processing system for executing computer readable instructions, the computer readable instructions controlling the processing system to perform operations. The operations include receiving the fluid data from a fluid downhole in a wellbore operation. The operations include defining a subset of the fluid data and a remaining subset of the fluid data. The operations include iteratively generating, by a processing device, a plurality of curves fit to the subset of the fluid data. The operations include performing, by the processing device, a validation on the plurality of curves as applied to the remaining subset of the fluid data to determine one or more best fit curves from the plurality of curves.

Other embodiments of the present invention implement features of the above-described method in computer systems and computer program products.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

Referring now to the drawings wherein like elements are numbered alike in the several figures.

DETAILED DESCRIPTION

Modern bottom hole assemblies (BHAs) are composed of several distributed components, such as sensors and tools, with each component performing data acquisition and/or processing of a special purpose. Some BHAs, such as those used in wireline logging operations and logging while drilling (LWD) operations, provide for fluid analysis sampling and testing to obtain formation pressure and formation fluid samples while drilling.

Figure 1:
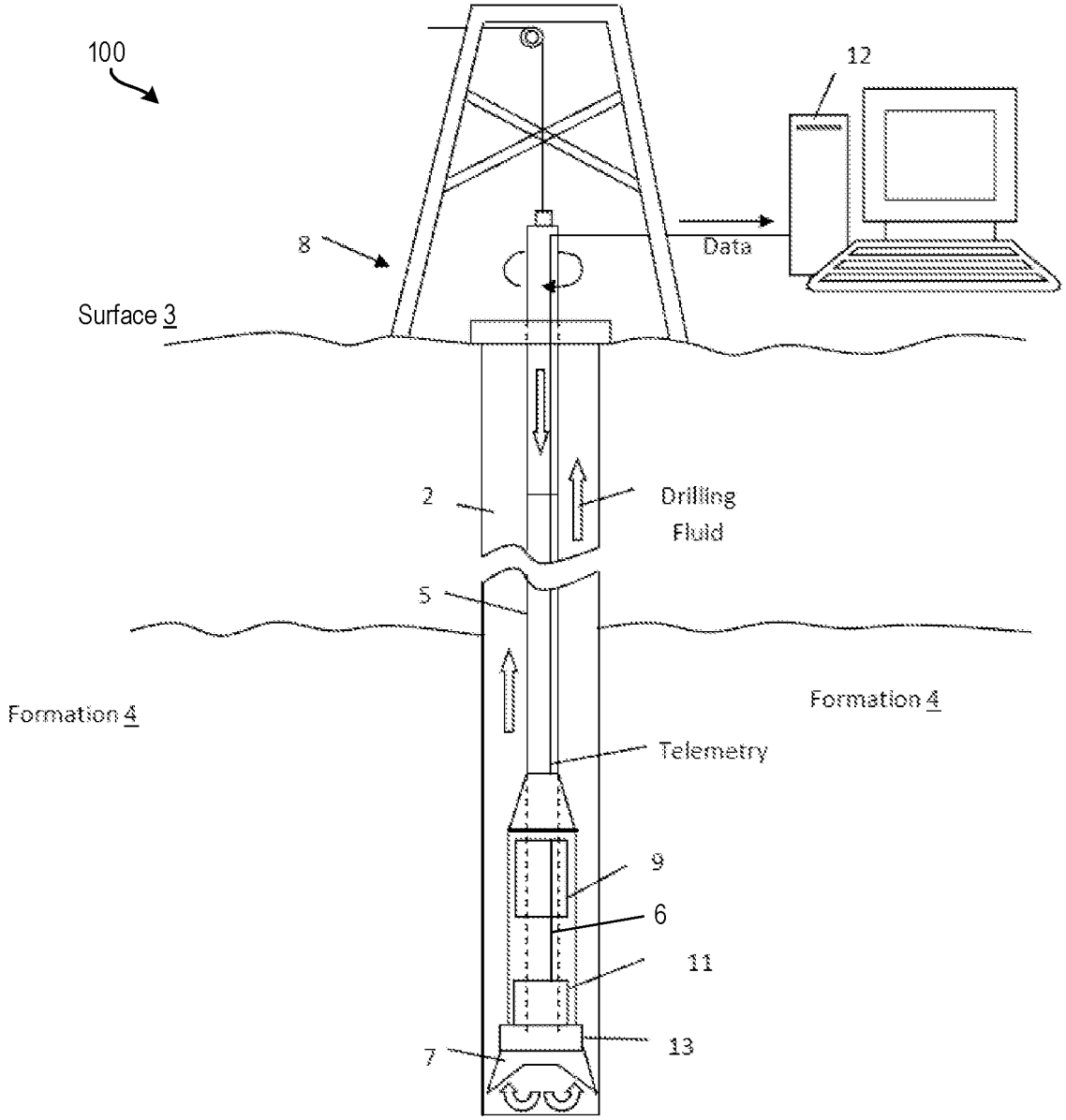
FIG. 1 depicts a cross-sectional view of a wellbore operation according to one or more embodiments described herein.

Wellbores are drilled into a subsurface to produce hydrocarbons and for other purposes. In particular, FIG. 1 depicts a cross-sectional view of a wellbore operation 100, according to aspects of the present disclosure. In traditional wellbore operations, LWD measurements are conducted during a drilling operation to determine formation rock and fluid properties of a formation 4. Those properties are then used for various purposes such as estimating reserves from saturation logs, defining completion setups, etc. as described herein.

The system and arrangement shown in FIG. 1 is one example to illustrate the downhole environment. While the system can operate in any subsurface environment, FIG. 1 shows a carrier 5 disposed in a borehole 2 penetrating the formation 4. The carrier 5 is disposed in the borehole 2 at a distal end of the borehole 2, as shown in FIG. 1.

As shown in FIG. 1, the carrier 5 is a drill string that includes a BHA 13. The BHA 13 is a part of the drilling rig 8 that includes drill collars, stabilizers, reamers, and the like, and the drill bit 7. In examples, the drill bit 7 is disposed at a forward end of the BHA 13. The BHA 13 also includes sensors (e.g., measurement tools 11) and electronic components (e.g., downhole electronic components 9). The measurements collected by the measurement tools 11 can include measurements related to drill string operations, for example. A drilling rig 8 is configured to conduct drilling operations such as rotating the drill string and, thus, the drill bit 7. The drilling rig 8 also pumps drilling fluid through the drill string in order to lubricate the drill bit 7 and flush cuttings from the borehole 2. The measurement tools 11 and downhole electronic components 9 are configured to perform one or more types of measurements in an embodiment known as logging-while-drilling (LWD) or measurement-while-drilling (MWD) according to one or more embodiments described herein. This can include, for example, fluid sampling operations.

Raw data is collected by the measurement tools 11 and transmitted to the downhole electronic components 9 for processing. The data can be transmitted between the measurement tools 11 and the downhole electronic components 9 by a powerline 6, which transmits power and data between the measurement tools 11 and the downhole electronic components 9, and/or by a wireless link (not shown) between the measurement tools 11 and the downhole electronic components 9. Power is generated downhole by a turbine-generation combination (not shown), and communication to the surface 3 (e.g., to a processing system 12) is cable-less (e.g., using mud pulse telemetry, electromagnetic telemetry, etc.) and/or cable-bound (e.g., using a cable to the processing system 12). The data processed by the downhole electronic components 9 can then be telemetered to the surface 3 for additional processing or display by the processing system 12.

Drilling control signals can be generated by the processing system 12 (e.g., based on the raw data collected by the measurement tools 11) and conveyed downhole or can be generated within the downhole electronic components 9 or by a combination of the two according to embodiments of the present disclosure. The downhole electronic components 9 and the processing system 12 can each include one or more processors and one or more memory devices. In alternate embodiments, computing resources such as the downhole electronic components 9, sensors, and other tools can be located along the carrier 5 rather than being located in the BHA 13, for example. The borehole 2 can be vertical as shown or can be in other orientations/arrangements (see, e.g., FIG. 3).

Figure 2:
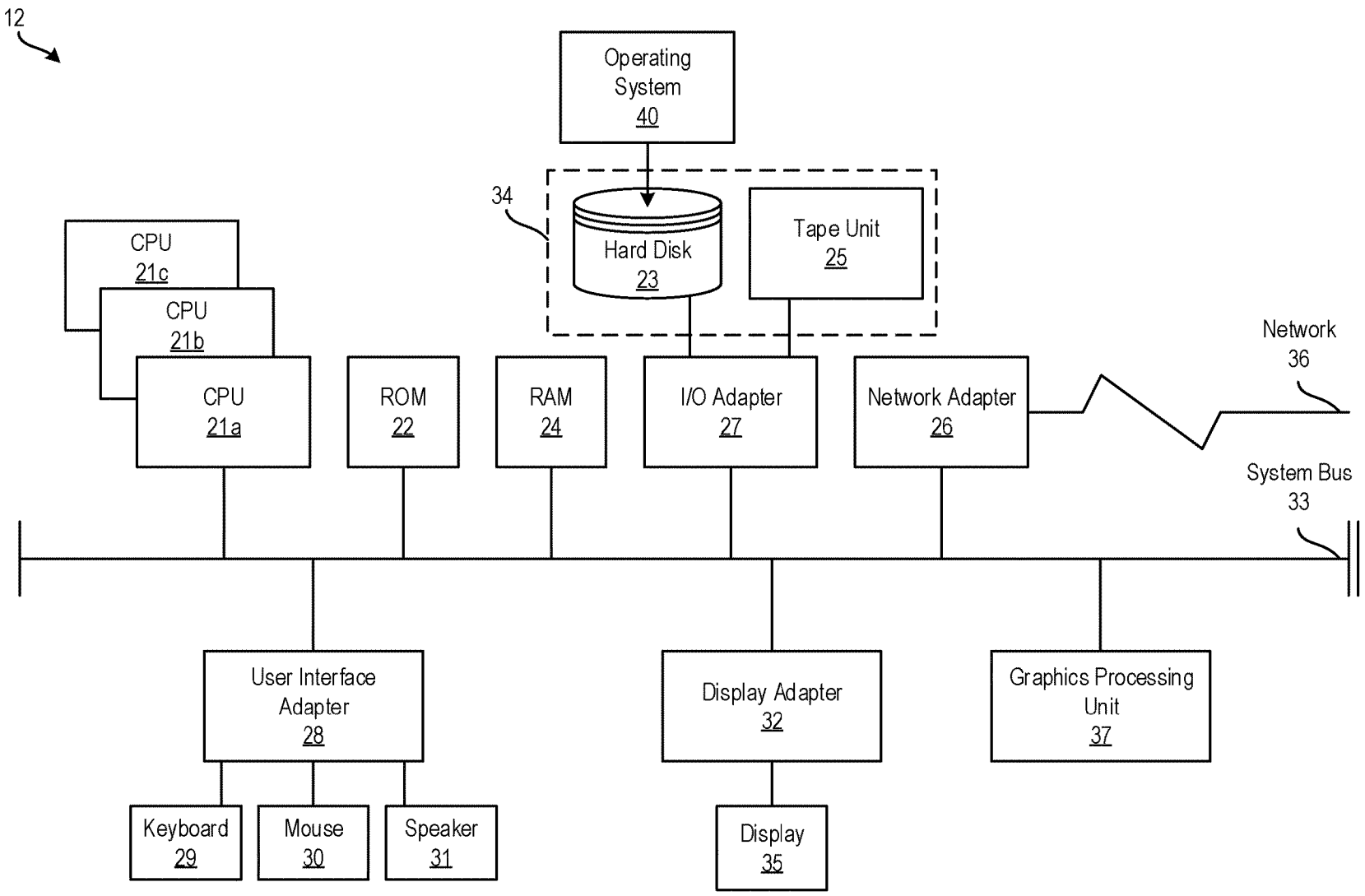
FIG. 2 depicts a block diagram of the processing system of FIG. 1, which can be used for implementing the present techniques herein according to one or more embodiments described herein.

It is understood that embodiments of the present disclosure are capable of being implemented in conjunction with any other suitable type of computing environment now known or later developed. For example, FIG. 2 depicts a block diagram of the processing system 12 of FIG. 1, which can be used for implementing the techniques described herein. In examples, processing system 12 has one or more central processing units 21*a*, 21*b*, 21*c*, etc. (collectively or generically referred to as processor(s) and/or as processing device(s)). In aspects of the present disclosure, each processor 21 can include a reduced instruction set computer (RISC) microprocessor. Processors 21 are coupled to system memory (e.g., random access memory (RAM) 24) and various other components via a system bus 33. Read only memory (ROM) 22 is coupled to system bus 33 and can include a basic input/output system (BIOS), which controls certain basic functions of processing system 12.

Further illustrated are an input/output (I/O) adapter 27 and a network adapter 26 coupled to system bus 33. I/O adapter 27 can be a small computer system interface (SCSI) adapter that communicates with a hard disk 23 and/or a tape storage drive 25 or any other similar component. I/O adapter 27, hard disk 23, and tape storage device 25 are collectively referred to herein as mass storage 34. Operating system 40 for execution on the processing system 12 can be stored in mass storage 34. The network adapter 26 interconnects system bus 33 with an outside network 36 enabling processing system 12 to communicate with other such systems.

A display (e.g., a display monitor) 35 is connected to system bus 33 by display adapter 32, which can include a graphics adapter to improve the performance of graphics intensive applications and a video controller. In one aspect of the present disclosure, adapters 26, 27, and/or 32 can be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 can be interconnected to system bus 33 via user interface adapter 28, which can include, for example, a Super I/O chip integrating multiple device adapters into a single integrated circuit.

In some aspects of the present disclosure, processing system 12 includes a graphics processing unit 37. Graphics processing unit 37 is a specialized electronic circuit designed to manipulate and alter memory to accelerate the creation of images in a frame buffer intended for output to a display. In general, graphics processing unit 37 is very efficient at manipulating computer graphics and image processing and has a highly parallel structure that makes it more effective than general-purpose CPUs for algorithms where processing of large blocks of data is done in parallel.

Thus, as configured herein, processing system 12 includes processing capability in the form of processors 21, storage capability including system memory (e.g., RAM 24), and mass storage 34, input means such as keyboard 29 and mouse 30, and output capability including speaker 31 and display 35. In some aspects of the present disclosure, a portion of system memory (e.g., RAM 24) and mass storage 34 collectively store an operating system to coordinate the functions of the various components shown in processing system 12.

According to examples described herein, techniques for automated contamination prediction based on downhole fluid sampling are provided. Drilling fluid (or "mud") is used during drilling downhole operations, such as LWD and wireline logging, to carry cuttings out of a borehole, provide hydrostatic pressure to prevent formation fluids from entering the wellbore, cooling and cleaning a drill bit while drilling, and others. Drilling fluid can become contaminated when foreign materials enter the drilling fluid, which can cause undesirable changes to drilling properties (e.g., viscosity, density, etc.). Such foreign materials can be introduced from the formation. Accordingly, it is desirable to predict contamination to reduce/avoid the negative effects associated with such contamination.

Conventionally, fluid contamination prediction is performed by acquiring fluid data about the drilling fluid and fitting a single curve to the data to predict contamination. This approach is highly subjective and results can vary significantly based on the user and the user's experience level. It is desirable to provide a less subjective, automated approach to provide a single repeatable result that can be updated in real-time (or near real-time) as drilling is performed. Accordingly, the present techniques provide a multiple automated curve fitting by varying the start and end points of the data for performing multiple curve fittings. By varying the start and end points of the data, different curve fit results are generated. Part of the original data is kept aside from curve fitting to perform validation on the multiple curve fittings. This enables comparing the actual data in this region with the multiple curve fits to determine the best curve fit(s) and eliminate outliers. From these best fits, a range of maximum cleanliness possible values can be determined (which are part of the curve fit). Additionally, statistical analytics can be performed to determine the best value for the maximum cleanliness possible and also provide some error on the best value.

Figure 3:
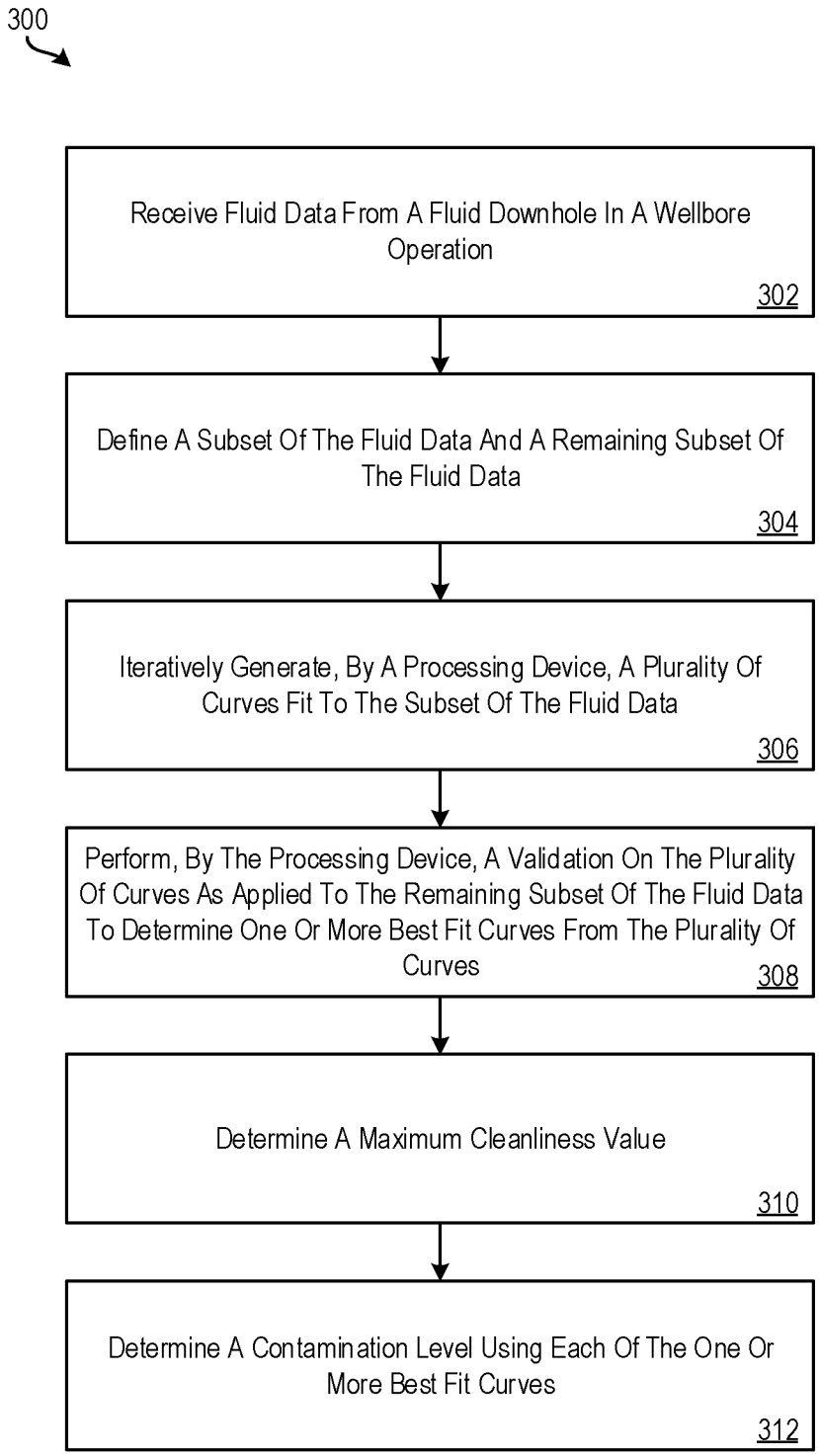
FIG. 3 depicts a flow diagram of a method for automated contamination prediction based on downhole fluid sampling according to one or more embodiments described herein.

FIG. 3 depicts a flow diagram of a method 300 for automated contamination prediction based on downhole fluid sampling according to one or more embodiments described herein. The method 300 can be performed by any suitable processing system (e.g., the processing system 12), any suitable processing device (e.g., one of the processors 21), and/or combinations thereof or the like or another suitable system or device.

At block 302, the processing system 12 receives fluid data from a fluid downhole in a wellbore operation. Data is acquired/collected, for example, by the measurement tools 11 and is then transmitted to the processing system 12 via cable-less and/or cable-bound techniques as described herein.

At block 304, the processing system 12 defines a subset of the fluid data and a remaining subset of the fluid data. That is, the processing system 12 selects part of the fluid data (i.e., the subset of the fluid data) for performing curve fitting and reserves the remaining part of the fluid data (i.e., the remaining subset of the fluid data) for post-curve fitting validation. Subsets of fluid data may be defined as a portion, such as a percentage of the fluid data set. For example, a subset of fluid data may be defined as a percentage value with respect to pumped volume, measurement time, number of data values, etc. As one example, the processing system 12 defines the subset of the fluid data as 80% of the fluid data to be used for curve fitting and the remaining subset of the fluid data as the remaining 20% of the fluid data for post-curve fitting validation. As another example, 85% of the fluid data can be defined as the subset of the fluid data with the remaining 15% of the fluid data being defined as the remaining subset of the fluid data. As yet another example, 60% of the fluid data can be defined as the subset of the fluid data with the remaining 40% of the fluid data being defined as the remaining subset of the fluid data. It should be appreciated that amounts other than the example amounts described herein can be defined for the respective subset of the fluid data and the remaining subset of the fluid data.

At block 306, the processing system 12 iteratively generates a plurality of curves fit to the subset of the fluid data. The iterative generation of a plurality of curves is further depicted in FIG. 4, which is now described.

Figure 4:
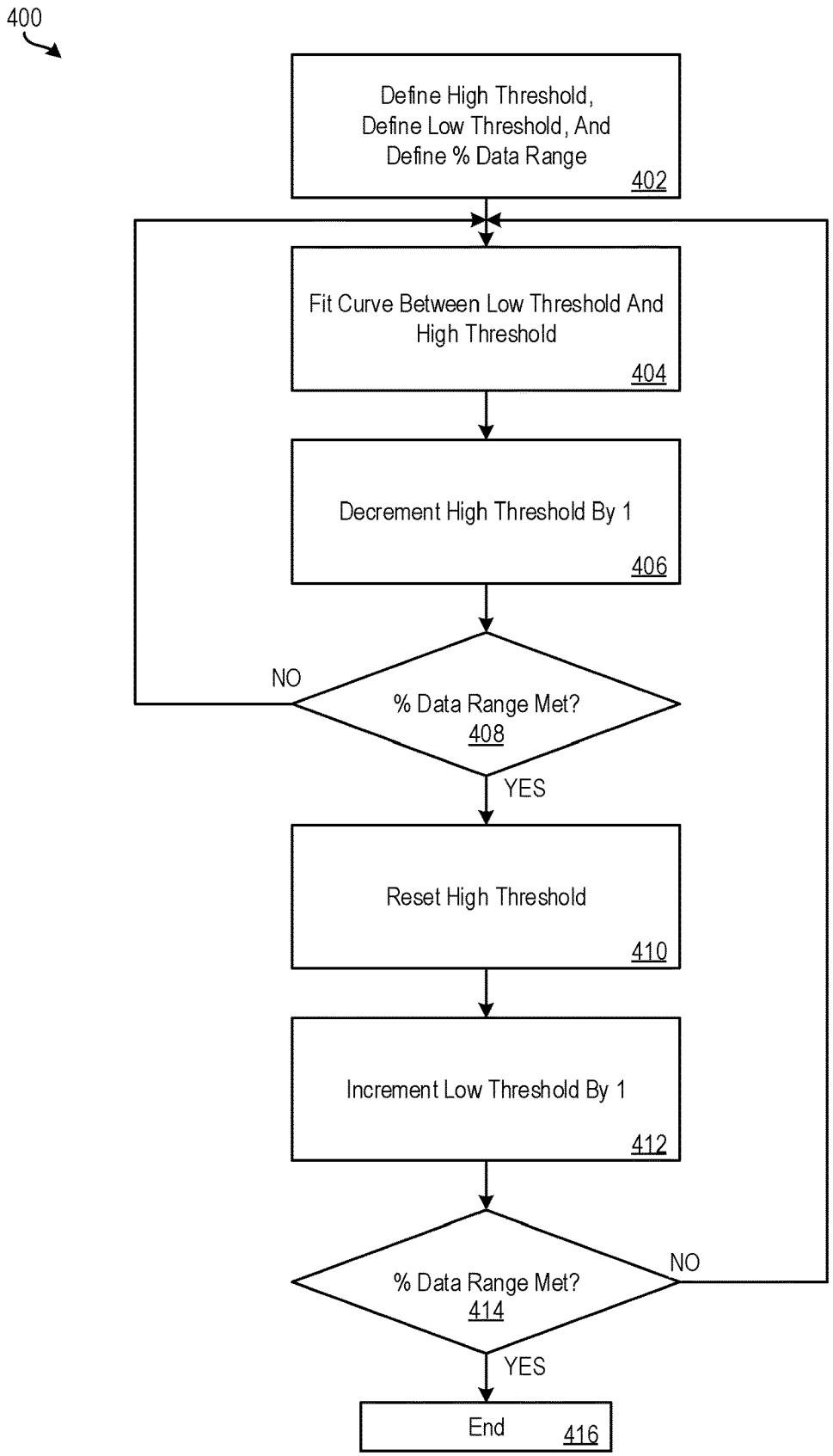
FIG. 4 depicts a flow diagram of a method for iteratively generating a plurality of curves according to one or more embodiments described herein.

In particular, FIG. 4 depicts a flow diagram of a method 400 for iteratively generating a plurality of curves to fit the subset of the fluid data according to one or more embodiments described herein.

At block 402, the method 400 includes defining a high threshold, a low threshold, and a percent (%) data range. The high threshold represents an upper bound of the subset of the fluid data, the low threshold represents a lower bound of the subset of the fluid data, and the % data range represents a minimum amount of the subset of the plurality of data that is used for iterative curve fitting.

At block 404, the method 400 includes fitting a curve between the low threshold and the high threshold. Fitting the curve can be performed by any suitable statistical approach, such as polynomial regression or interpolation; Gaussian, Lorentzian, or Voigt distributions; trigonometric fitting; and the like. Once a curve is fit between the low threshold and the high threshold, the method 400 proceeds to block 406 where the high threshold is decremented, such as by one or more units, a certain percentage (e.g., 1%), or the like.

At decision block 408, it is determined whether the amount of data between the low and high thresholds is greater than the % data range. If so, the method 400 returns to fitting a curve between the low threshold and the high threshold (that has been decremented). In this way, the process iteratively fits curves to subsets of the data between the low threshold and the high threshold, each curve fitting being applied to a different portion of the data as the high threshold is reduced down to the % data range. If it is determined at decision block 408 that the % data range is met, the method 400 proceeds to block 410, and the high threshold is reset back to its original value (see block 402).

At block 412, the low threshold is incremented, such as by one or more units, a certain percentage (e.g., 1%), or the like. It is then determined, at decision block 414, whether the amount of data between the low and high thresholds is greater than the % data range. If not, the method 400 returns to fitting a curve between the low threshold (that has been incremented) and the high threshold, which is iteratively decremented from its original value as described above (see blocks 404, 406, 408). In this way, for each iterative increment in the low threshold, curves are fit for the subset of data between the low and high threshold as the low and high thresholds are incremented and decremented respectively. If it is determined at decision block 414 that the amount of data between the low and high thresholds is met, the method ends at block 416.

With continued reference to FIG. 3, once iterative curve fitting has been completed at block 306 using the method 400 depicted in FIG. 4, the method 300 proceeds to block 308.

At block 308, the processing system 12 performs a validation on the plurality of curves as applied to the remaining subset of the fluid data to determine one or more best fit curves from the plurality of curves. That is, the remaining subset of the fluid data that was not used for curve fitting is used to validate the curves that were fit during iterative curve fitting to determine one or more "best" curves. To do this, the processing system 12 extrapolates the fits of the plurality of curves to the remaining subset of the plurality of fluid data (e.g., the remaining 20% in an example in which the subset of the fluid data that was used for iterative curve fitting was 80%). A best fit approach, such as a linear best fit approach, is then applied across this remaining subset of the plurality of fluid data to determine which of the plurality of curves is a "best" curve (or curves) by comparing the best fit of the data (e.g., the linear best fit of the data) to the various curves. One approach for such comparison is to compare a slope of the data using two points (e.g., a first point and a last point) to the slopes of the curves using the value of points corresponding to the same two points for the slope of the data. In such an example, the best fit curve(s) would be the one(s) with the slope closest to the actual data. The average of the remaining subset of the fluid data should be similar to the curve fit average over this time interval as well as the average should fall within one standard deviation of the data range. By comparing the fit between the actual data and the fit curves, determine the best fit curve (the best fit curve would be the one with the slope closest to the actual data) and with that the best value for the maximum cleanliness possible. By comparing the fit between the actual data and the fit curves, the best fit curve (i.e., the curve with the slope closest to the actual data) is determined and with that the best value for the maximum cleanliness possible can be determined.

At block 310, the processing system 12 determines a maximum cleanliness value based on the best value for the maximum cleanliness possible. From block 308, the best value for the maximum cleanliness possible is provided as well as a range of values for the maximum cleanliness values (based on the various curve fits generated). This, when plotted, provides a distribution of the maximum cleanliness value. In some examples, this value may be a skewed distribution due to outliers based on curve fits of very early time data only used for the fit generation. With the best value as well as the distribution of the values, a portion of the values (e.g., 10% of the values (5% each around the best-fit value)) are used to generate a second distribution. This second distribution is referred to as an "error calculation distribution." The standard deviation is then calculated with the error calculation distribution to determine a one standard deviation and/or a two standard deviation range for the value of maximum cleanliness. Thus, the best value for the maximum cleanliness possible is provided as well as the +/− range over different confidence interval.

At block 312, the processing system 12 determines a contamination level using each of the one or more best fit curves. A user provides a filtrate value for the particular curves. The filtrate value—or value of curve for filtrate as it is sometimes called—can be used along with the other information described herein to calculate a contamination level using the following contamination equation:

$$\text{Contamination} = 100 * \left( \frac{|\text{Value of curve at time } T - \text{Value of curve at maximum cleanliness}|}{|\text{Value of curve for filtrate} - \text{Value of curve at maximum cleanliness}|} \right).$$

In the contamination equation, where value of curve at time T is a value of the one or more best fit curves at a time T, the value of curve at maximum cleanliness is a value of the one or more best fit curves at a time infinity (∞), and the value of curve for filtrate is a value of the one or more best fit curves at the filtrate value. According to one or more embodiments described herein, the value of curve at maximum cleanliness in the equation above can be replaced with the +/− values to generate the error range on the calculated contamination. Monitoring contamination with time and comparing with a predefined contamination threshold allows to estimate the point of time when the contamination is sufficient low (e.g., less than a threshold). Upon estimation when contamination matches the predefined contamination threshold, a sampling procedure may be initiated when the tool actually starts to take the sample for analysis downhole and/or uphole. With selected ranges, the filtrate value, and the predefined contamination threshold, monitoring contamination with time, comparing with the predefined contamination threshold, and initiating the sampling procedure of the sampling tool may be automatic processes that are executed from downhole without any interaction from the surface.

Additional processes also may be included, and it should be understood that the processes depicted in FIG. 3 and FIG. 4 represent illustrations, and that other processes may be added or existing processes may be removed, modified, or rearranged without departing from the scope of the present disclosure.

Figure 5:
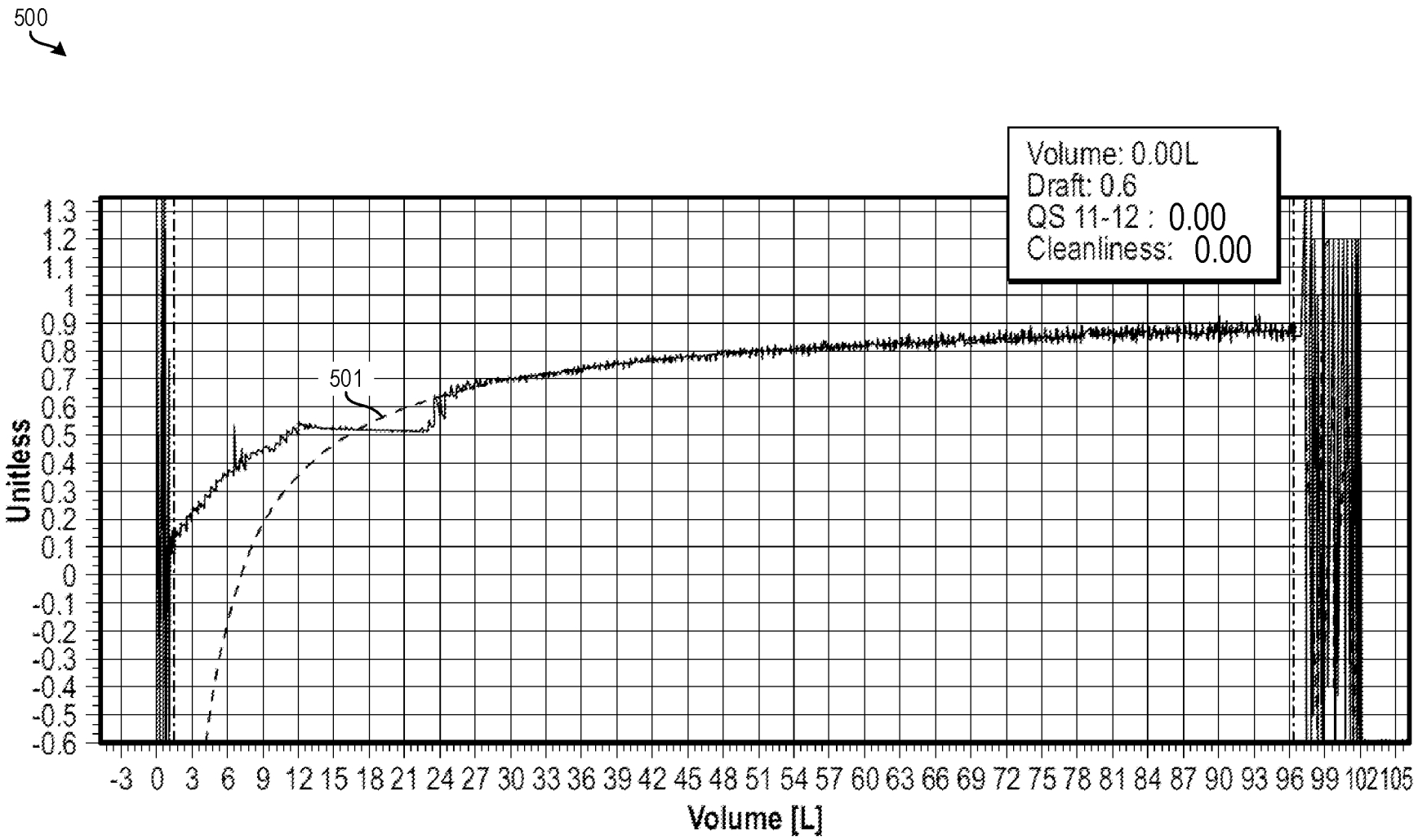
FIG. 5 depicts a graph of a measured wellbore parameter plotted against volume having a single fit curve according to one or more embodiments described herein.

FIG. 5 depicts a graph 500 of a measured wellbore parameter plotted against volume having a single fit curve 501 according to one or more embodiments described herein. In the graph 500, the single fit curve 501 is fit to the data without using iterative curve fitting as described herein. As can be seen, the single fit curve 501 provides only a fair representation of the data.

Figure 6:
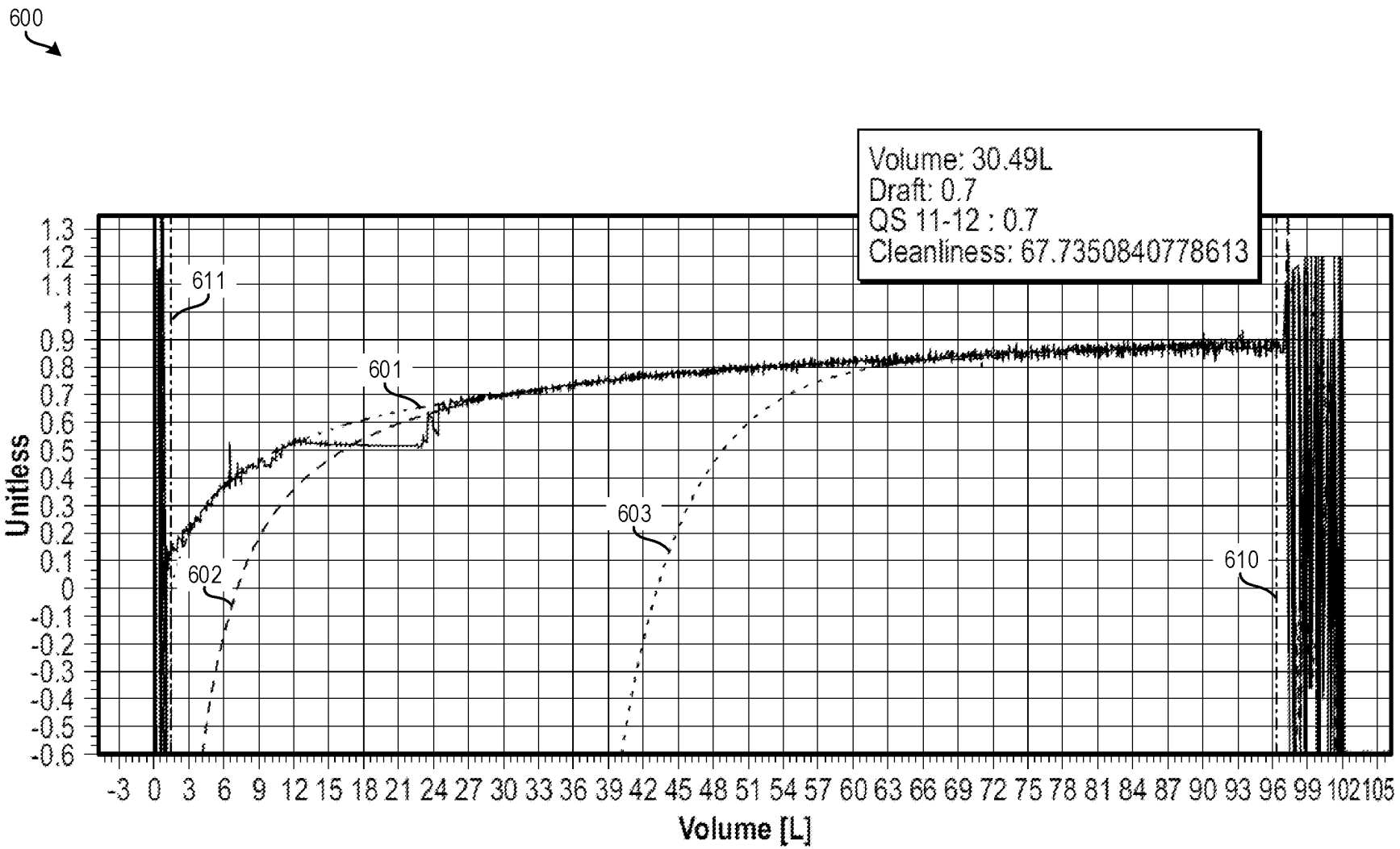
FIG. 6 depicts a graph of a measured wellbore parameter plotted against volume having multiple fit curves according to one or more embodiments described herein.

In contrast to the graph 500, FIG. 6 depicts a graph 600 of a measured wellbore parameter plotted against volume having multiple fit curves 601, 602, 603 according to one or more embodiments described herein. The multiple fit curves 601, 602, 603 are fit using the iterative curve fitting described herein. In the graph 600, the multiple fit curves 601, 602, 603 begin at different points along the volume axis, which is a result of the iterative fitting process (see, e.g., FIG. 4). This is done by decrementing a high threshold 610 and decrementing a low threshold 611 as described herein.

Figure 7:
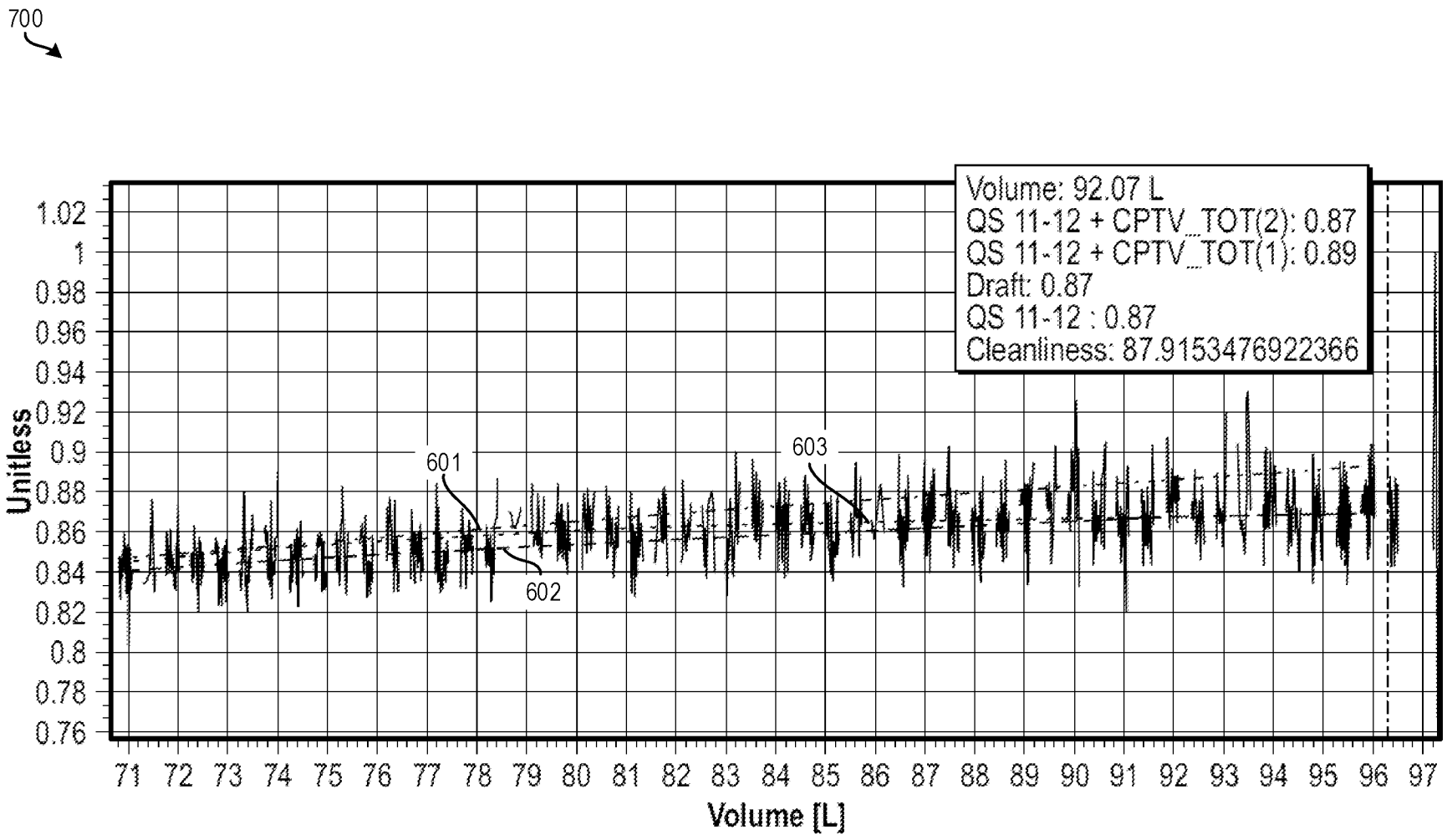
FIG. 7 depicts a graph of a measured wellbore parameter plotted against volume having the multiple fit curves of FIG. 6 extrapolated over additional data according to one or more embodiments described herein.

FIG. 7 depicts a graph 700 of a measured wellbore parameter plotted against volume having the multiple fit curves 601, 602, 603 of FIG. 6 extrapolated over additional data according to one or more embodiments described herein. As described herein, the multiple fit curves 601, 602, 603 are applied to the remaining subset of the plurality of fluid data (e.g., the remaining 20% in an example in which the subset of the fluid data that was used for iterative curve fitting was 80%). This enables comparing the fit between the actual data and the fit curves to determine the best-fit curve.

Example embodiments of the disclosure include or yield various technical features, technical effects, and/or improvements to technology. Example embodiments of the disclosure provide technical solutions for automated contamination prediction based on downhole fluid sampling. These technical solutions provide a less subjective, automated approach to provide a single repeatable result that can be updated in real-time (or near real-time) as drilling is performed. Accordingly, the present techniques provide a multiple automated curve fitting by varying the start and end points of the data for performing multiple curve fittings. By varying the start and end points of the data, different curve fit results are generated. Part of the original data is kept aside from curve fitting to perform validation on the multiple curve fittings. This enables comparing the actual data in this region with the multiple curve fits to determine the best curve fit(s) and eliminate outliers. This increases hydrocarbon recovery from a hydrocarbon reservoir compared to conventional techniques.

Set forth below are some embodiments of the foregoing disclosure:

Embodiment 1: A downhole sampling method comprising: receiving fluid data from a fluid downhole in a wellbore operation; defining a subset of the fluid data and a remaining subset of the fluid data; iteratively generating, by a processing device, a plurality of curves fit to the subset of the fluid data; and performing, by the processing device, a validation on the plurality of curves as applied to the remaining subset of the fluid data to determine one or more best fit curves from the plurality of curves.

Embodiment 2: A method according to any prior embodiment, further comprising determining a maximum cleanliness value.

Embodiment 3: A method according to any prior embodiment, further comprising determining a contamination level using each of the one or more best fit curves.

Embodiment 4: A method according to any prior embodiment, wherein iteratively generating the plurality of curves further comprises: defining a low threshold; defining a high threshold; and defining a percent data range.

Embodiment 5: A method according to any prior embodiment, wherein iteratively generating the plurality of curves further comprises iteratively generating a first plurality of curves between the low threshold and the high threshold, wherein the high threshold is decremented each iteration until the percent data range is met.

Embodiment 6: A method according to any prior embodiment, wherein iteratively generating the plurality of curves further comprises incrementing the low threshold.

Embodiment 7: A method according to any prior embodiment, wherein iteratively generating the plurality of curves further comprises, subsequent to incrementing the low threshold, iteratively generating a second plurality of curves between the low threshold and the high threshold, wherein the high threshold is decremented each iteration until the percent data range is met.

Embodiment 8: A method according to any prior embodiment, wherein iteratively generating the plurality of curves further comprises incrementing the low threshold.

Embodiment 9: A method according to any prior embodiment, wherein iteratively generating the plurality of curves further comprises, subsequent to incrementing the low threshold, iteratively generating a third plurality of curves between the low threshold and the high threshold, wherein the high threshold is decremented each iteration until the percent data range is met.

Embodiment 10: A method according to any prior embodiment, wherein the contamination level is based on a filtrate value.

Embodiment 11: A system to sample downhole fluid, the system comprising: a drilling rig comprising a bottom hole assembly disposed in a wellbore and configured to acquire fluid data; a processing system comprising a memory and a processor, the processing system being disposed at a surface of the wellbore, the processing system for executing the computer readable instructions, the computer readable instructions controlling the processing device to perform operations comprising: receiving fluid data from a fluid downhole in a wellbore operation; defining a subset of the fluid data and a remaining subset of the fluid data; iteratively generating, by a processing device, a plurality of curves fit to the subset of the fluid data; performing, by the processing device, a validation on the plurality of curves as applied to the remaining subset of the fluid data to determine one or more best fit curves from the plurality of curves; determining a maximum cleanliness value; and determining a contamination level using each of the one or more best fit curves.

Embodiment 12: A system according to any prior embodiment, wherein the processing system performs operations further comprising determining a maximum cleanliness value.

Embodiment 13: A system according to any prior embodiment, wherein the processing system performs operations further comprising determining a contamination level using each of the one or more best fit curves.

Embodiment 14: A system according to any prior embodiment, wherein iteratively generating the plurality of curves further comprises: defining a low threshold; defining a high threshold; and defining a percent data range.

Embodiment 15: A system according to any prior embodiment, wherein iteratively generating the plurality of curves further comprises iteratively generating a first plurality of curves between the low threshold and the high threshold, wherein the high threshold is decremented each iteration until the percent data range is met.

Embodiment 16: A system according to any prior embodiment, wherein iteratively generating the plurality of curves further comprises incrementing the low threshold.

Embodiment 17: A system according to any prior embodiment, wherein iteratively generating the plurality of curves further comprises, subsequent to incrementing the low threshold, iteratively generating a second plurality of curves between the low threshold and the high threshold, wherein the high threshold is decremented each iteration until the percent data range is met.

Embodiment 18: A system according to any prior embodiment, wherein iteratively generating the plurality of curves further comprises incrementing the low threshold.

Embodiment 19: A system according to any prior embodiment, wherein iteratively generating the plurality of curves further comprises, subsequent to incrementing the low threshold, iteratively generating a third plurality of curves between the low threshold and the high threshold, wherein the high threshold is decremented each iteration until the percent data range is met.

Embodiment 20: A system according to any prior embodiment, wherein the contamination level is based on a filtrate value.

The use of the terms "a" and "an" and "the" and similar referents in the context of describing the present disclosure (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure can be used in a variety of well operations. These operations can involve using one or more treatment agents to treat a formation, the fluids resident in a formation, a wellbore, and/or equipment in the wellbore, such as production tubing. The treatment agents can be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the present disclosure has been described with reference to an exemplary embodiment or embodiments, it will be understood by those skilled in the art that various changes can be made and equivalents can be substituted for elements thereof without departing from the scope of the present disclosure. In addition, many modifications can be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims. Also, in the drawings and the description, there have been disclosed exemplary embodiments of the present disclosure and, although specific terms can have been employed, they are unless otherwise stated used in a generic and descriptive sense only and not for purposes of limitation, the scope of the present disclosure therefore not being so limited.

What is claimed is:

1. A downhole sampling method comprising:

performing a wellbore operation;

receiving fluid data from a fluid downhole in the wellbore operation;

defining a subset of the fluid data and a remaining subset of the fluid data;

iteratively generating, by a processing device, a plurality of curves fit to the subset of the fluid data, wherein iteratively generating the plurality of curves comprises defining a low threshold, a high threshold, and a minimum amount of the subset of the fluid data, and further comprises iteratively generating a first plurality of curves between the low and high thresholds, wherein the high threshold is decremented each iteration to provide a decremented high threshold, until the minimum amount of the subset of the fluid data is met;

performing, by the processing device, a validation on the plurality of curves by applying the first plurality of curves to the remaining subset of the fluid data to determine one or more best fit curves from the first plurality of curves; and performing the wellbore operation using at least one of the one or more best fit curves, the performing including initiating a sampling procedure based on the at least one of the one or more best fit curves.

2. The method of claim 1, wherein performing the wellbore operation comprises determining a maximum cleanliness value.

3. The method of claim 1, wherein performing the wellbore operation comprises determining a contamination level using the at least one of the one or more best fit curves.

4. The method of claim 3, wherein the contamination level is based on a filtrate value.

5. The method of claim 1, wherein iteratively generating the plurality of curves further comprises incrementing the low threshold to provide an incremented low threshold.

6. The method of claim 5, wherein iteratively generating the plurality of curves further comprises, subsequent to incrementing the low threshold, iteratively generating a second plurality of curves between the incremented low threshold and the decremented high threshold, wherein the decremented high threshold is further decremented each iteration, to provide a further decremented high threshold, until the minimum amount of the subset of the fluid data is met.

7. The method of claim 6, wherein iteratively generating the plurality of curves further comprises further incrementing the incremented low threshold to provide a further incremented low threshold.

8. The method of claim 7, wherein iteratively generating the plurality of curves further comprises, subsequent to further incrementing the incremented low threshold, iteratively generating a third plurality of curves between the further incremented low threshold and the further decremented high threshold, wherein the further decremented high threshold is further decremented each iteration until the minimum amount of the subset of the fluid data is met.

9. The method of claim 1, wherein the minimum amount of the subset of the fluid data is a percentage.

10. The method of claim 1, wherein initiating the sampling procedure is based on comparing the at least one of the one or more best fit curves to a selected contamination threshold.

11. A system to sample downhole fluid, the system comprising:

a drilling rig comprising a bottom hole assembly disposed in a wellbore and configured to acquire fluid data;

a processing system comprising a memory and a processor, the processing system for executing computer readable instructions, the computer readable instructions controlling the processing system to perform operations comprising:

receiving the fluid data from a fluid downhole in a wellbore operation;

defining a subset of the fluid data and a remaining subset of the fluid data;

iteratively generating a plurality of curves fit to the subset of the fluid data, wherein iteratively generating the plurality of curves comprises defining a low threshold, a high threshold, and a minimum amount of the subset of the fluid data, and further comprises iteratively generating a first plurality of curves between the low and high thresholds, wherein the high threshold is decremented each iteration to provide a decremented high threshold, until the minimum amount of the subset of the fluid data is met;

performing a validation on the plurality of curves by applying the first plurality of curves to the remaining subset of the fluid data to determine one or more best fit curves from the first plurality of curves; and performing the wellbore operation using at least one of the one or more best fit curves, the performing including initiating a sampling procedure based on the at least one of the one or more best fit curves.

12. The system of claim 11, wherein performing the wellbore operation comprises determining a maximum cleanliness value.

13. The system of claim 11, wherein performing the wellbore operation comprises determining a contamination level using the at least one of the one or more best fit curves.

14. The system of claim 13, wherein the contamination level is based on a filtrate value.

15. The system of claim 11, wherein iteratively generating the plurality of curves further comprises incrementing the low threshold to provide an incremented low threshold.

16. The system of claim 15, wherein iteratively generating the plurality of curves further comprises, subsequent to incrementing the low threshold, iteratively generating a second plurality of curves between the incremented low threshold and the decremented high threshold, wherein the decremented high threshold is further decremented each iteration, to provide a further decremented high threshold, until the minimum amount of the subset of the fluid data is met.

17. The system of claim 16, wherein iteratively generating the plurality of curves further comprises further incrementing the incremented low threshold to provide a further incremented low threshold.

18. The system of claim 17, wherein iteratively generating the plurality of curves further comprises, subsequent to further incrementing the incremented low threshold, iteratively generating a third plurality of curves between the further incremented low threshold and the further decremented high threshold, wherein the further decremented high threshold is further decremented each iteration until the minimum amount of the subset of the fluid data is met.

19. The system of claim 11, wherein the minimum amount of the subset of the fluid data is a percentage.

20. The system of claim 11, wherein initiating the sampling procedure is based on comparing the at least one of the one or more best fit curves to a selected contamination threshold.

* * * * *